US012286680B2

(12) United States Patent
Kohsaka et al.

(10) Patent No.: US 12,286,680 B2
(45) Date of Patent: Apr. 29, 2025

(54) THIN STEEL SHEET AND METHOD FOR MANUFACTURING SAME

(71) Applicant: JFE Steel Corporation, Tokyo (JP)

(72) Inventors: Noriaki Kohsaka, Tokyo (JP); Junya Tobata, Tokyo (JP); Shinjiro Kaneko, Tokyo (JP); Yasushi Kitani, Tokyo (JP); Yoshihiko Ono, Tokyo (JP); Tadachika Chiba, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 943 days.

(21) Appl. No.: 17/284,981

(22) PCT Filed: Oct. 15, 2019

(86) PCT No.: PCT/JP2019/040400
§ 371 (c)(1),
(2) Date: Apr. 13, 2021

(87) PCT Pub. No.: WO2020/080339
PCT Pub. Date: Apr. 23, 2020

(65) Prior Publication Data

US 2021/0381077 A1 Dec. 9, 2021

(30) Foreign Application Priority Data

Oct. 17, 2018 (JP) ..... 2018-195602

(51) Int. Cl.
*C21D 9/46* (2006.01)
*C21D 8/02* (2006.01)
(Continued)

(52) U.S. Cl.
CPC ..... *C21D 9/46* (2013.01); *C21D 8/0226* (2013.01); *C21D 8/0236* (2013.01);
(Continued)

(58) Field of Classification Search
None
See application file for complete search history.

(56) References Cited

U.S. PATENT DOCUMENTS

2014/0000765 A1* 1/2014 Nozaki ..... C22C 38/06 148/333
2015/0000796 A1 1/2015 Kakiuchi et al.
(Continued)

FOREIGN PATENT DOCUMENTS

CN 102149841 A 8/2011
CN 102421925 A 4/2012
(Continued)

OTHER PUBLICATIONS

Chinese Office Action with Search Report for Chinese Application No. 201980067526.2, dated Nov. 16, 2021, 8 pages.
(Continued)

*Primary Examiner* — Brian D Walck
(74) *Attorney, Agent, or Firm* — Buchanan Ingersoll & Rooney PC

(57) ABSTRACT

A thin steel sheet has a specific chemical composition. The thin steel sheet has a microstructure in which ferrite is present in an area fraction of 4% or less (including 0%), as-quenched martensite is present in an area fraction of 10% or less (including 0%), retained austenite is present in an amount of 7% or more and 20% or less, and upper bainite, lower bainite, and tempered martensite are present in a total area fraction of more than 71% and less than 93%; and BCC iron that has a misorientation of 1° or less and surrounds retained austenite having an equivalent circular diameter of 1 μm or less is present in an area fraction of 4% or more and 50% or less, and BCC iron that has a misorientation of more than 1° is present in an area fraction of 25% or more and 85% or less.

4 Claims, 1 Drawing Sheet

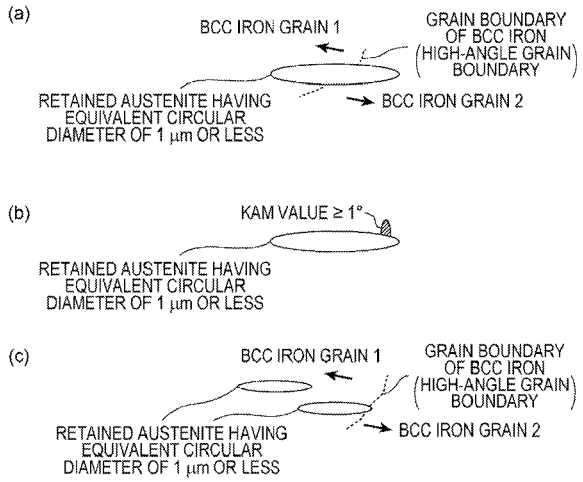

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.

CPC ..... *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C21D 2201/05* (2013.01); *C21D 2211/001* (2013.01); *C21D 2211/002* (2013.01); *C21D 2211/005* (2013.01); *C21D 2211/008* (2013.01)

(56) References Cited

U.S. PATENT DOCUMENTS

| | | | |
|---|---|---|---|
| 2015/0086808 | A1 | 3/2015 | Kasuya et al. |
| 2016/0369369 | A1 | 12/2016 | Takashima et al. |
| 2017/0107591 | A1 | 4/2017 | Takashima et al. |
| 2017/0145534 | A1 | 5/2017 | Takashima et al. |
| 2020/0157647 | A1* | 5/2020 | Ono ..... C22C 38/04 |

FOREIGN PATENT DOCUMENTS

| | | | |
|---|---|---|---|
| CN | 104099515 | A | 10/2014 |
| CN | 107208209 | A | 9/2017 |
| EP | 2327810 | A1 | 6/2011 |
| EP | 2431491 | A1 | 3/2012 |
| EP | 3260565 | A1 | 12/2017 |
| EP | 3395981 | A1 | 10/2018 |
| EP | 3611285 | A1 | 2/2020 |
| JP | 2001192786 | A | 7/2001 |
| JP | 2013181184 | A | 9/2013 |
| JP | 2017214647 | A | 12/2017 |
| JP | 2017214648 | A | 12/2017 |
| JP | 2018095896 | A | 6/2018 |
| KR | 101714930 | B1 | 3/2017 |
| WO | 2015115059 | A1 | 8/2015 |
| WO | 2015151427 | A1 | 10/2015 |
| WO | 2015161419 | A1 | 10/2015 |
| WO | 2018055425 | A1 | 3/2018 |

OTHER PUBLICATIONS

International Search Report and Written Opinion for International Application No. PCT/JP2019/040400, dated Jan. 7, 2020, 6 pages.

European Communication pursuant to Article 94(3) for European Application No. 19 874 333.8, dated Mar. 1, 2023, 6 pages.

Kodym, M. et al., "Trace Elements in Steel—Possibilities for Influencing the Smelting Operation," Autorenkollektiv: "Spurenelemente im Stahl," Duesseldorf, DE, Jan. 1, 1985, one page, XP002433212, with partial English translation.

Extended European Search Report for European Application No. 19 874 333.8, dated Jul. 22, 2021, 11 pages.

* cited by examiner

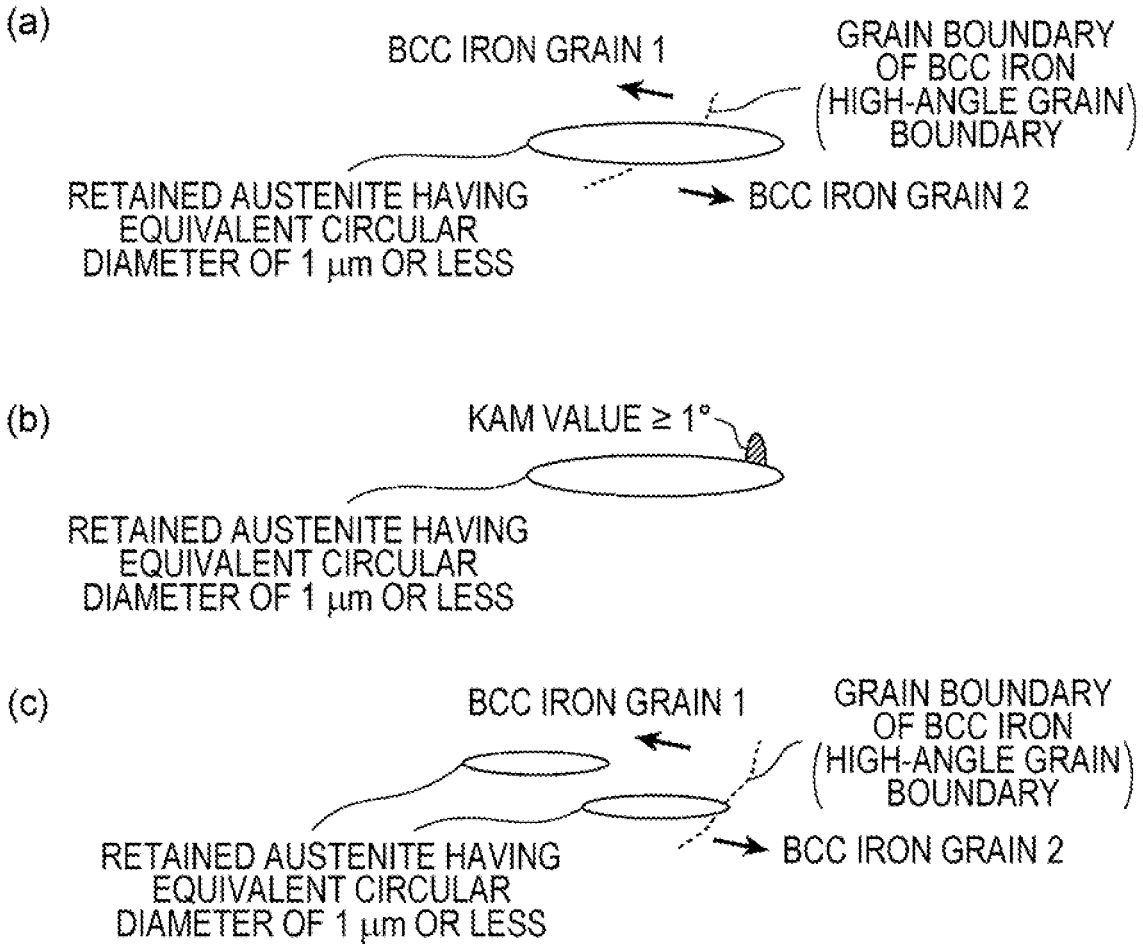
(a)
BCC IRON GRAIN 1
GRAIN BOUNDARY OF BCC IRON (HIGH-ANGLE GRAIN BOUNDARY)
RETAINED AUSTENITE HAVING EQUIVALENT CIRCULAR DIAMETER OF 1 μm OR LESS
BCC IRON GRAIN 2
(b)
KAM VALUE ≥ 1°
RETAINED AUSTENITE HAVING EQUIVALENT CIRCULAR DIAMETER OF 1 μm OR LESS
(c)
BCC IRON GRAIN 1
GRAIN BOUNDARY OF BCC IRON (HIGH-ANGLE GRAIN BOUNDARY)
RETAINED AUSTENITE HAVING EQUIVALENT CIRCULAR DIAMETER OF 1 μm OR LESS
BCC IRON GRAIN 2

THIN STEEL SHEET AND METHOD FOR MANUFACTURING SAME

CROSS REFERENCE TO RELATED APPLICATIONS

This is the U.S. National Phase application of PCT/JP2019/040400, filed Oct. 15, 2019, which claims priority to Japanese Patent Application No. 2018-195602, filed Oct. 17, 2018, the disclosures of these applications being incorporated herein by reference in their entireties for all purposes.

FIELD OF THE INVENTION

The present invention relates to a thin steel sheet and a method for manufacturing the same. The thin steel sheet according to aspects of the present invention has a strength of 980 MPa or higher in terms of tensile strength (TS) and also has excellent workability. Accordingly, the thin steel sheet according to aspects of the present invention is suitable as a material for an automotive seat component.

BACKGROUND OF THE INVENTION

In recent years, from the standpoint of global environmental protection, in the entire automobile industry, there is a trend toward improving the fuel efficiency of automobiles to limit $CO_2$ emission. The most effective way to improve the fuel efficiency of automobiles is to reduce the weight of automobiles by using thinner components, and, therefore, in recent years, the volume of high-strength steel sheets used as a material for automotive components has been increasing.

In general, there is a tendency that the formability of a steel sheet decreases with an increase in strength thereof, and, therefore, further expanding the widespread use of high-strength steel sheets requires improving formability. Accordingly, there is an increasing need for a material that has a formability.

As a technique for improving formability, various technologies regarding a TRIP steel sheet, which utilizes retained austenite, have been known in the past.

For example, Patent Literature 1 states that a 1180 MPa or higher steel sheet that has excellent elongation and stretch flange formability and has a high yield ratio can be obtained; this is achieved because the steel sheet contains ferrite having an average crystal grain diameter of 3 μm or less and a volume fraction of 5% or less, retained austenite having a volume fraction of 10% or more and 20% or less, and martensite having an average crystal grain diameter of 4 μm or less and a volume fraction of 20% or less, with the balance including bainite and/or tempered martensite, and, in the steel sheet, cementite grains having a grain diameter of 0.1 μm or more are precipitated, with an average number of the cementite grains per 100 $\mu m^2$ in a cross section in the thickness direction parallel to the rolling direction of the steel sheet being 30 or more.

Patent Literature 2 and 3 each state that a steel sheet having excellent elongation, hole expandability, and deep drawability can be obtained; this is achieved because a ferrite fraction is 5% or less, or, a ferrite fraction is more than 5% and 50% or less, and an amount of retained austenite is 10% or more, and in addition, MA, which is a composite structure formed of retained austenite and martensite, is refined, and retained austenite having a size of 1.5 μm or larger is increased.

PATENT LITERATURE

PTL 1: International Publication No. WO2015-115059

PTL 2: Japanese Unexamined Patent Application Publication No. 2017-214648

PTL 3: Japanese Unexamined Patent Application Publication No. 2017-214647

SUMMARY OF THE INVENTION

It is stated that in the technology proposed in Patent Literature 1, if cementite were not precipitated, a hardness of tempered martensite and bainite would increase, which would result in degraded stretch flange formability. That is, a strength and formability of a steel sheet necessarily vary with the state of precipitation of cementite. As such, with the technology proposed in Patent Literature 1, it is impossible to obtain a steel sheet having stable mechanical properties.

It is stated that in the technologies proposed in Patent Literature 2 and 3, if a carbon-rich region were too large, MA would be coarse, which would result in a reduction in hole expandability and a reduced hole expansion ratio. In TRIP steel, with an increase in an amount of carbon enrichment in retained austenite, ductility increases; however, a problem is encountered in that it is impossible to maximally obtain the effect of TRIP because it has been also desired to achieve a stretch flange formability.

For the technologies proposed in all the patent literature, there is a need to realize excellent formability and high strength at a higher level. To meet the need, objects according to aspects of the present invention are to provide a thin steel sheet having a tensile strength of 980 MPa or higher and good formability and to provide a method for manufacturing the same.

To achieve the objects described above, the present inventors performed studies regarding requirements for improving formability. Aspects of the present invention are primarily concerned with seat components, for which very high bendability is required. In this instance, since there is an influence of reverse bending before a final step, it is necessary to inhibit a sheet thickness of a bent portion from being reduced in a situation in which bending-unbending is being experienced; accordingly, not only a typical bendability but also a high uniform elongation and amount of work hardening need to be ensured, too. An effective way to realize this is to ensure that BCC iron having small crystal structure disturbance is present in a specific fraction or more. This is a finding that was made. Furthermore, refining a size of a hard phase is necessary for inhibiting the formation of voids in instances in which tension and compression are repeated. This is another finding that was made. It was discovered that an effective way to inhibit crystal disturbances of BCC iron and refine a size of a hard phase is to, after allowing a reverse transformation into austenite to progress sufficiently during annealing, perform holding at approximately 450° C. and subsequently perform rapid cooling. Thin steel sheets with which aspects of the present invention are concerned have a sheet thickness of 0.4 mm or more and 2.6 mm or less.

A diligent search was conducted regarding the production conditions for components of a steel sheet and a structure of the steel sheet that satisfy the requirements described above. As a result, aspects of the present invention were completed. A summary thereof is as follows.

[1] A thin steel sheet which comprises: a chemical composition containing, in mass %, C: 0.10% or more and 0.23% or less, Si: 1.30% or more and 2.20% or less, Mn: 2.0% or more and 3.2% or less, P: 0.05% or less, S: 0.005% or less, Al: 0.005% or more and 0.100% or less, and N: 0.0060% or less, with the balance being Fe and incidental impurities; and a microstructure including ferrite in an area fraction of 4% or less (including 0%), as-quenched martensite in an area fraction of 10% or less (including 0%), retained austenite in an amount of 7% or more and 20% or less, and upper bainite, lower bainite, and tempered martensite in a total area fraction of more than 71% and less than 93%; and BCC iron having a misorientation of 1° or less and surrounds retained austenite having an equivalent circular diameter of 1 μm or less is present in an area fraction of 4% or more and 50% or less, and BCC iron having a misorientation of more than 1° is present in an area fraction of 25% or more and 85% or less.

[2] A thin steel sheet which comprises: a chemical composition that contains, in mass %, C: 0.10% or more and 0.23% or less, Si: 1.30% or more and 2.20% or less, Mn: 2.0% or more and 3.2% or less, P: 0.05% or less, S: 0.005% or less, Al: 0.005% or more and 0.100% or less, and N: 0.0060% or less, with the balance being Fe and incidental impurities; and a microstructure including ferrite in an area fraction of 4% or less (including 0%), as-quenched martensite in an area fraction of 10% or less (including 0%), retained austenite in an amount of 7% or more and 20% or less, and upper bainite, lower bainite, and tempered martensite in a total area fraction of more than 71% and less than 93%; and BCC iron having a misorientation of 1° or less and surrounds retained austenite having an equivalent circular diameter of 1 μm or less is present in an area fraction of 5% or more and 50% or less, and BCC iron having a misorientation of more than 1° is present in an area fraction of 25% or more and 85% or less.

[3] The thin steel sheet according to [1] or [2], wherein the chemical composition further contains, in mass %, Sb: 0.001% or more and 0.050% or less.

[4] The thin steel sheet according to any one of [1] to [3], wherein the chemical composition further contains, in mass %, one or more of Ti: 0.001% or more and 0.1% or less, Nb: 0.001% or more and 0.1% or less, V: 0.001% or more and 0.3% or less, Ni: 0.01% or more and 0.1% or less, Cr: 0.01% or more and 1.0% or less, and B: 0.0002% or more and 0.0050% or less.

[5] The thin steel sheet according to any one of [1] to [4], wherein the chemical composition further contains, in mass %, one or more of Cu: 0.01% or more and 0.2% or less, Mo: 0.01% or more and 1.0% or less, REM: 0.0002% or more and 0.050% or less, Mg: 0.0002% or more and 0.050% or less, and Ca: 0.0002% or more and 0.050% or less.

[6] A method for manufacturing a thin steel sheet which comprises cold rolling a hot-rolled steel sheet having the chemical composition according to any one of [1] to [5] with a cold rolling reduction ratio of 46% or more, and annealing the cold-rolled steel sheet including, after the cold rolling: heating and holding the cold-rolled steel sheet at 815° C. or higher for 130 seconds or more; subsequently, cooling the cold-rolled steel sheet with an average cooling rate from 800° C. to 520° C. of 8° C./s or higher to a temperature range of 420° C. or higher and 520° C. or lower; holding the cold-rolled steel sheet in the temperature range for 12 seconds or more and 60 seconds or less; cooling the cold-rolled steel sheet with an average cooling rate in a temperature range from 420° C. to 300° C. of 8° C./s or higher to a cooling stop temperature of 200° C. or higher and 350° C. or lower; holding the cold-rolled steel sheet in a temperature range within ±50° C. of the cooling stop temperature for 2 seconds or more and 25 seconds or less; and thereafter, heating the cold-rolled steel sheet to a temperature of 300° C. or higher and 500° C. or lower and, subsequently, holding the cold-rolled steel sheet in the temperature range for 480 seconds or more and 1800 seconds or less.

In accordance with aspects of the present invention, a thin steel sheet having a high strength of 980 MPa or higher in terms of tensile strength (TS) and excellent formability are provided. In instances in which a thin steel sheet according to aspects of the present invention is used in an automotive component, a further weight reduction in automotive components is realized.

BRIEF DESCRIPTION OF THE DRAWINGS

FIGS. 1(*a*) to 1(*c*) are schematic diagrams for explaining the definition of BCC iron that has a misorientation of 1° or less and surrounds retained austenite having an equivalent circular diameter of 1 μm or less as defined in accordance with aspects of the present invention.

DETAILED DESCRIPTION OF EMBODIMENTS OF THE INVENTION

Embodiments of the present invention will be described in detail below.

A chemical composition and a microstructure of a thin steel sheet according to aspects of the present invention will be described in this order. Note that in the following description of the chemical composition, "%" representing a content of a component means "mass %".

C: 0.10% or more and 0.23% or less

C contributes to increasing the strength of steel sheets and, in addition, has an effect of promoting the formation of retained austenite, thereby increasing workability. Achieving the tensile strength of 980 MPa or higher sought in accordance with aspects of the present invention and a desired hardness of a molten metal portion requires C content of at least more than or equal to 0.10%. Preferably, C content is more than or equal to 0.11%. On the other hand, if C content is more than 0.23%, BCC iron having small crystal disturbance and fine retained austenite are not obtained; that is, workability is degraded. Accordingly, C content is specified to be less than or equal to 0.23%. Preferably, the C content is less than or equal to 0.22%.

Si: 1.30% or more and 2.20% or less

Si increases an elongation of steel sheets. Accordingly, Si content is specified to be more than or equal to 1.30%. Preferably, Si content is more than or equal to 1.35%. On the other hand, if Si is added in an excessive amount, chemical conversion properties are degraded, and, therefore, suitability for forming automotive members is lost. From this standpoint, Si content is specified to be less than or equal to 2.20%. Preferably, Si content is less than or equal to 2.10%.

Mn: 2.0% or more and 3.2% or less

Mn is an austenite-stabilizing element and is an element necessary for inhibiting a ferrite phase from remaining, thereby achieving an area fraction of retained austenite. Accordingly, Mn content is specified to be more than or equal to 2.0%. Preferably, Mn content is more than or equal to 2.1%. On the other hand, if the Mn content is excessively high, the effect described above no longer increases, and in addition, problems with castability and rollability arise. Accordingly, Mn content is specified to be less than or equal to 3.2%. Preferably, Mn content is less than or equal to 3.0%.

P: 0.05% or less

P is a harmful element because P reduces weldability. Thus, it is preferable that P content be reduced as much as possible. In accordance with aspects of the present invention, P content of up to 0.05% is permissible. Preferably, P content is less than or equal to 0.02%. For usage under more severe welding conditions, it is more preferable that P content be limited to less than or equal to 0.01%. On the other hand, P may be unintentionally incorporated in an amount of up to 0.002% in association with production.

S: 0.005% or less

S forms coarse sulfides in steel, and such sulfides are elongated during hot rolling and form wedge-shaped inclusions. As such, S adversely affects weldability. Thus, S is also a harmful element, and, therefore, it is preferable that an amount of S be reduced as much as possible. In accordance with aspects of the present invention, S content of up to 0.005% is permissible, and, accordingly, S content is specified to be less than or equal to 0.005%. Preferably, S content is less than or equal to 0.003%. For usage under more severe welding conditions, it is more preferable that S content be limited to less than or equal to 0.001%. S may be unintentionally incorporated in an amount of up to 0.0002% in association with production.

Al: 0.005% or more and 0.100% or less

Al is added as a deoxidizing agent at the stage of steelmaking. For the purpose of addition, Al content is specified to be more than or equal to 0.005%. On the other hand, if Al is present in an amount more than 0.100%, the effect of serving as a deoxidizing agent no longer increases, and in addition, castability is degraded. From this standpoint, Al content is specified to be less than or equal to 0.100%. Preferably, Al content is less than or equal to 0.085%.

N: 0.0060% or less

N is a harmful element that adversely affects formability because N degrades room-temperature aging properties and causes unexpected cracking. Accordingly, it is desirable that an amount of N be reduced as much as possible. In accordance with aspects of the present invention, an amount of N of up to 0.0060% is permissible. Preferably, the amount is less than or equal to 0.0050%. While it is desirable that N content be reduced as much as possible, N may be unintentionally incorporated in an amount of up to 0.0005% in association with production.

The thin steel sheet according to aspects of the present invention has a chemical composition that contains the basic components described above, with the balance, other than the basic components described above, including Fe (iron) and incidental impurities. It is preferable that the thin steel sheet according to aspects of the present invention have a chemical composition that contains the basic components described above, with the balance being Fe and incidental impurities.

The chemical composition according to aspects of the present invention may contain, in addition to the basic components described above, the following elements as optional elements.

The chemical composition may contain, in mass %, Sb: 0.001% or more and 0.050% or less. Sb is an element useful for inhibiting decarburization in a surface of a steel sheet during annealing at high temperature, thereby ensuring mechanical properties consistently. Producing this effect requires the presence of Sb in an amount more than or equal to 0.001%. On the other hand, if Sb is present in an amount more than 0.050%, the effect no longer increases. Accordingly, a Sb content is specified to be less than or equal to 0.050%.

The chemical composition may further contain, in addition to the components described above, one or more of Ti: 0.001% or more and 0.1% or less, Nb: 0.001% or more and 0.1% or less, V: 0.001% or more and 0.3% or less, Ni: 0.01% or more and 0.1% or less, Cr: 0.01% or more and 1.0% or less, and B: 0.0002% or more and 0.0050% or less.

Ti and Nb are elements that contribute to increasing strength. On the other hand, if Ti and/or Nb are included in an excessive amount, a pinning effect is produced, and as a result, the formation of BCC iron having small crystal structure disturbance is hindered. Accordingly, it is preferable that a Ti content be 0.001% or more and 0.1% or less, and a Nb content be 0.001% or more and 0.1% or less.

V has a high solubility in steel and, therefore, can be dissolved to some extent in the case of high-temperature annealing, toward which aspects of the present invention are directed. On the other hand, if V is added in an excessive amount, a pinning effect is produced as with Ti and Nb, and as a result, BCC iron having small crystal structure disturbance is not obtained. Accordingly, it is preferable that a V content be 0.001% or more and 0.3% or less. More preferably, the lower limit of the sum of the Ti content, the Nb content, and the V content is more than or equal to 0.005%, and more preferably, the sum of the Ti content and the Nb content is less than or equal to 0.1%.

Ni, Cr, and B increase hardenability, and as a result, BCC iron that has a misorientation of 1° or less and surrounds retained austenite having an equivalent circular diameter of 1 μm or less, which will be described later, is easily obtained. On the other hand, if these elements are included in an excessive amount, fine retained austenite is not obtained, and the effect of hardenability no longer increases. Accordingly, the ranges of Ni: 0.01% or more and 0.1% or less, Cr: 0.01% or more and 1.0% or less, and B: 0.0002% or more and 0.0050% or less for B are preferable.

The chemical composition may further contain, in addition to the components described above, one or more of Cu: 0.01% or more and 0.2% or less, Mo: 0.01% or more and 1.0% or less, one or more REMs: 0.0002% or more and 0.050% or less, Mg: 0.0002% or more and 0.050% or less, and Ca: 0.0002% or more and 0.050% or less. These elements are elements that are used to adjust strength and control inclusions, for example. In instances in which these elements are present in amounts in the ranges mentioned above, the effects according to aspects of the present invention are not impaired.

The components other than the components described above are Fe and incidental impurities. Furthermore, in instances in which any of the optional elements is included in an amount less than the lower limit, since the effects according to aspects of the present invention are not impaired by the optional element present in an amount less than the lower limit, it is to be assumed that the optional element present in an amount less than the lower limit is present as an incidental impurity.

Now, the microstructure of the thin steel sheet according to aspects of the present invention will be described.

Ferrite is Present in Area Fraction of 4% or Less (including 0%)

In accordance with aspects of the present invention, during annealing, a reverse transformation into austenite is allowed to progress sufficiently, holding is subsequently performed at approximately 450° C. to form an appropriate fraction of BCC iron that has small crystal disturbance and envelops fine retained austenite, and subsequently, quenching is performed to form a fine low-temperature-transformation phase. Accordingly, if a ferrite phase is formed in an excessive amount, the formation of a desired microstructure in the process of the holding is delayed. In addition, since the ferrite formed during annealing is soft, voids tend to form at interfaces between the ferrite and a hard phase adjacent thereto; therefore, bendability is reduced. A permissible range for inhibiting such influence is 4%, and, accordingly, an area fraction of ferrite is specified to be less than or equal to 4%. Preferably, the area fraction is less than or equal to 3%. The ferrite according to aspects of the present invention is polygonal ferrite and is a constituent in which corrosion traces and second-phase constituents are not present in the grains.

As-Quenched Martensite is Present in Area Fraction of 10% or Less (Including 0%)

As-quenched martensite is very hard, and, in bending, grain boundaries thereof act as initiation sites for cracking near a surface; therefore, as-quenched martensite significantly reduces bendability. Achieving a bendability sought in accordance with aspects of the present invention requires ensuring that an area fraction of as-quenched martensite is less than or equal to 10%. Preferably, the area fraction is less than or equal to 3%. It is preferable that the area fraction of as-quenched martensite be as small as possible; the area fraction may be 0%.

Retained Austenite is Present in Amount of 7% or More and 20% or Less

Retained austenite improves formability. Achieving the tensile characteristic sought in accordance with aspects of the present invention requires the formation of retained austenite in an amount more than or equal to 7%. Accordingly, an area fraction of retained austenite is specified to be more than or equal to 7%. Preferably, the amount is more than or equal to 8%. On the other hand, an excessive amount of retained austenite degrades delayed fracture characteristics, and, accordingly, the area fraction of retained austenite is specified to be less than or equal to 20%. Preferably, the amount is less than or equal to 17%.

Upper Bainite, Lower Bainite, and Tempered Martensite are Present in Total Amount of More than 71% and Less than 93%

It is desirable that a region other than those of the constituents described above be primarily formed of upper bainite, lower bainite, and tempered martensite. In instances in which the matrix of the steel sheet is primarily formed of these low-temperature-transformation constituents, the desired strength is easily achieved, and a hardness distribution of the microstructure is narrowed, which leads to alleviation of local stress concentration during bending: therefore, bendability is improved. To enable these effects to be effectively exhibited, a total amount of these constituents is specified to be more than 71% and less than 93%.

BCC Iron that has Misorientation of 1° or Less and Surrounds Retained Austenite Having an Equivalent Circular Diameter of 1 μm or Less is Present in Area Fraction of 4% or More and 50% or Less BCC iron having small crystal disturbance has high ductility and increases an amount of dislocation strengthening associated with deformation. Accordingly, such BCC iron increases an amount of work hardening and a uniform elongation. One of the features according to aspects of the present invention is that such BCC iron surrounds retained austenite having an equivalent circular diameter of 1 μm or less, that is, BCC iron that has small crystal disturbance and envelops fine retained austenite is to be formed. As used herein, the term "surround" refers to, as determined by the method described in the Examples section, enclosing 90% or more of the outer periphery of the retained austenite having an equivalent circular diameter of 1 μm or less. With such a microstructure, BCC iron having small crystal disturbance is preferentially deformed in low-strain deformation, and, when dislocations accumulate, the BCC iron is hardened, retained austenite undergoes a plasticity-induced transformation, and, accordingly, a high amount of work hardening is achieved in a high-strain deformation region; therefore, a characteristic of a high resistance to bending-unbending is achieved. In addition, in the instance in which retained austenite is transformed into martensite and, therefore, becomes hard, BCC iron that has small crystal disturbance and surrounds the martensite alleviates local stress concentration associated with the difference in hardness between different phases; therefore, bendability is improved. When an area fraction of the BCC iron that surrounds fine retained austenite is at least 4%, local stress concentration associated with the difference in hardness between different phases is alleviated, and, therefore, good bendability is guaranteed. This is a finding that was made. Accordingly, achieving such a characteristic requires that the area fraction of the BCC iron that surrounds fine retained austenite be more than or equal to 4%. Preferably, the area fraction is more than or equal to 5%, more preferably, more than or equal to 7%, and even more preferably, more than or equal to 10%. On the other hand, if the area fraction is more than 50%, the desired strength of the steel sheet is not achieved. Accordingly, the area fraction of the BCC iron that has a misorientation of 1° or less and surrounds fine retained austenite is specified to be less than or equal to 50%. Preferably, the area fraction is less than or equal to 45%. Furthermore, if the equivalent circular diameter of the fine retained austenite is more than 1 μm, the retained austenite undergoes a plasticity-induced transformation with a relatively low strain, and as a result, a desired work hardening characteristic is not achieved. Accordingly, the equivalent circular diameter of the retained austenite surrounded by the BCC iron is specified to be less than or equal to 1 μm. Note that in instances in which the microstructure according to aspects of the present invention is achieved, the formation of BCC iron that surrounds retained austenite having an equivalent circular diameter of more than 1 μm is inhibited, and, therefore, desired characteristics are obtained.

The area fraction of the BCC iron that has a misorientation of 1° or less and surrounds retained austenite having an equivalent circular diameter of 1 μm or less can be measured as follows; by using EBSD (electron beam backscattering diffraction), regions having a KAM value of 1° or less are identified, and then, regions having an average of equivalent circular diameters of 1 μm or less are extracted. In instances in which the equivalent circular diameter is more than 1 μm, such regions are to be excluded even when the KAM value of the BCC iron is 1° or less. Regions to be excluded are those within the range of the block having the same orientation. As described, the misorientation can be represented by the KAM value, which is measured by the method described in the Examples section.

BCC Iron Having Misorientation of More than 1° is Present in Area Fraction of 25% or More and 85% or Less Constituents having a misorientation of more than 1° are lower bainite, martensite, and tempered martensite, for example. These constituents contribute to increasing the strength of the steel sheet, and in addition, in instances in which fine lower constituents are developed in crystal grains, the microscopic interfaces serve as an obstruction to the propagation of cracks that form in bending. As a result, not only the above-described effect of the formation of a hard and uniform structure but also a synergistic effect of improving bendability is produced. Sufficiently producing these effects requires that an area fraction of BCC iron having a misorientation of more than 1° be more than 25%. On the other hand, these constituents have low plastic deformability, and, therefore, if the area fraction is more than 85%, a desired formability is not achieved. Accordingly, the area fraction of the BCC iron having a misorientation of more than 1° is specified to be 25% or more and 85% or less. Preferably, the range is 35% or more and 75% or less.

The constituents of the remainder are not particularly limited. As long as the microstructure described above is achieved, the effects according to aspects of the invention are not impaired even if one or more other constituents coexist.

Now, a method for manufacturing the thin steel sheet according to aspects of the present invention will be described. The method for manufacturing the thin steel sheet according to aspects of the present invention includes a hot rolling step, a cold rolling step, and an annealing step. Each of the steps will be described below.

The hot rolling step is a step of hot-rolling a steel starting material having the chemical composition described above.

Methods for manufacturing molten steel for the production of the steel starting material are not particularly limited; any known method for manufacturing molten steel, such as a method using a converter, an electric furnace, or the like, may be employed. Furthermore, secondary refining may be carried out in a vacuum degassing furnace. Subsequently, a slab (steel starting material) may be formed by using a continuous casting method, which is preferable in terms of issues such as productivity and quality. Alternatively, the slab may be formed by using a known casting method such as an ingot casting-slabbing rolling method or a thin slab continuous casting method.

Hot rolling conditions for hot-rolling the steel starting material are not particularly limited and may be appropriately specified. For example, an after-hot-rolling coiling temperature may be lower than or equal to 580° C.; more preferably, in terms of a shape of the coil for cold rolling, the coiling temperature may be specified to be lower than or equal to 530° C.

The cold rolling step is a step of performing pickling and cold rolling after the hot rolling step described above. In the cold rolling, a cold rolling reduction ratio needs to be more than or equal to 46% so as to enable nucleation for the reverse transformation in the subsequent heating process to be distributed in a highly dense manner to promote the reverse transformation into austenite. Preferably, the cold rolling reduction ratio is more than or equal to 50%. The upper limit thereof is not specified but, in practice, less than or equal to 75% because of a load of cold rolling. Conditions for the pickling are not particularly limited, and conditions may be specified according to a typical method.

After the cold rolling step and before the annealing step, which will be described later, it is more preferable to perform a heat treatment step in which the steel sheet is heated to a temperature of 480° C. or higher and 650° C. or lower, and then the steel sheet is held in the temperature range for 1 hour or more. In instances in which the heat treatment is carried out, finer cementite precipitates, and, accordingly, the reverse transformation progresses to a greater extent with the cementite serving as nuclei; as a result, the desired structure is easily obtained.

The annealing step is a step that is performed as follows: after the cold rolling step, the resulting steel sheet is heated and held at 815° C. or higher for 130 seconds or more; subsequently, the resulting steel sheet is cooled with an average cooling rate from 800° C. to 520° C. of 8° C./s or higher to a temperature of 420° C. or higher and 520° C. or lower; then, the resulting steel sheet is held at the temperature of 420° C. or higher and 520° C. or lower for 12 seconds or more and 60 seconds or less; then, the resulting steel sheet is cooled with an average cooling rate from 420° C. to 300° C. of 8° C./s or higher to a cooling stop temperature of 200° C. or higher and 350° C. or lower; then, the resulting steel sheet is held in a temperature range within ±50° C. of the cooling stop temperature for 2 seconds or more and 25 seconds or less; and thereafter, the resulting steel sheet is heated to a temperature of 300° C. or higher and 500° C. or lower and, subsequently, held in the temperature range for 480 seconds or more and 1800 seconds or less.

Heating Temperature: 815° C. or Higher

Holding Time: 130 Seconds or More

In this heating and holding, the reverse transformation into austenite is allowed to progress sufficiently to create a base for forming, in an appropriately balanced manner, BCC iron that has a misorientation of 1° or less and surrounds retained austenite and BCC iron having a misorientation of more than 1°. In this instance, if the reverse transformation into austenite does not progress sufficiently, the formation of the BCC iron that has a misorientation of 1° or less and surrounds retained austenite is insufficient, and a fraction of the BCC iron having a misorientation of more than 1° is also low, which results in degraded resistance to bending-unbending. Obtaining desired austenite requires holding at 815° C. or higher for 130 seconds or more. Preferably, the holding is performed at 830° C. or higher for 130 seconds or more, and more preferably, the holding is performed at 850° C. or higher for 140 seconds or more. The upper limit of the heating temperature is not particularly limited. For a reason of thermal damage to the heating furnace, it is preferable that the upper limit be 900° C. or lower. Furthermore, the upper limit of the holding time is not particularly limited. From the standpoint of productivity, it is preferable that the upper limit be 350 seconds or less.

Average Cooling Rate from 800° C. to 520° C.: 8° C./s or Higher

Cooling Stop Temperature: 420° C. or Higher and 520° C. or Lower

After the heating, it is necessary to inhibit the formation of polygonal ferrite. If polygonal ferrite forms during this period, the BCC iron that has small crystal disturbance and contains fine retained austenite cannot be obtained, and, therefore, the desired characteristics of the steel sheet cannot be obtained. From this standpoint, the average cooling rate over the range of 800° C. to 520° C., which is a polygonal-ferrite-formation range, is specified to be higher than or equal to 8° C./s. Preferably, the average cooling rate is higher than or equal to 10° C./s. The upper limit of the average cooling rate is not particularly specified. The upper limit is, in practice, less than or equal to 150° C./s.

Inhibiting the formation of polygonal ferrite and forming BCC iron that has small crystal structure disturbance and surrounds fine retained austenite require cooling to a temperature of 420° C. or higher and 520° C. or lower. If the temperature is lower than 420° C., the martensitic transformation progresses, which results in a large crystal structure disturbance, and, therefore, the desired microstructure cannot be obtained. Accordingly, the cooling stop temperature is specified to be higher than or equal to 420° C. Preferably, the cooling stop temperature is higher than or equal to 450° C. If the cooling stop temperature is higher than 520° C., fine retained austenite cannot be obtained as a result of an influence of the formation of polygonal ferrite. Accordingly, the cooling stop temperature is specified to be lower than or equal to 520° C.

Holding Time in Temperature Range of 420° C. or Higher and 520° C. or Lower: 12 Seconds or More and 60 Seconds or Less The holding in the temperature range of 420° C. or higher and 520° C. or lower for 12 seconds or more and 60 seconds or less enables the formation of the BCC iron that has small crystal structure disturbance and surrounds fine retained austenite. If the holding temperature is lower than 420° C., or the holding time in the range of 420° C. or higher and 520° C. or lower is less than 12 seconds, a sufficient amount of the BCC iron that has small crystal disturbance and surrounds fine retained austenite cannot be obtained. Preferably, the holding time is more than or equal to 15 seconds. On the other hand, if the holding temperature is higher than 520° C., desired retained austenite cannot be obtained. If the holding time in the range of 420° C. or higher and 520° C. or lower is more than 60 seconds, the BCC iron having small crystal disturbance form in an excessive amount, and as a result, the desired tensile strength of 980 MPa cannot be achieved. Preferred ranges for the holding are 430° C. or higher and 505° C. or lower, and, 20 seconds or more and 55 seconds or less. Furthermore, in this holding, temperature variations are permissible as long as the temperatures are within any of the above-mentioned temperature ranges, or isothermal holding is also possible.

Average Cooling Rate from 420° C. to 300° C.: 8° C./s or Higher

Cooling Stop Temperature: 200° C. or Higher and 350° C. or Lower

To refine a microstructure that forms in a cooling process and promote the formation of BCC iron having a misorientation of more than 1°, it is necessary to perform cooling in a manner such that an average cooling rate over a range of 420° C. to 300° C. is 8° C./s or higher. If the average cooling rate is less than 8° C./s, the refining of a lower constituent is inhibited, and the formation of the BCC iron having a misorientation of more than 1° is insufficient. Preferably, the average cooling rate is higher than or equal to 10° C./s. The upper limit of the average cooling rate is not particularly limited.

After the cooling, the cooling is stopped in a temperature range of 200° C. or higher and 350° C. or lower. Preferably, the temperature range is 230° C. or higher and 330° C. or lower. If the cooling stop temperature is lower than 200° C., austenite present in the steel sheet is transformed into martensite, and as a result, the desired amount of retained austenite cannot be obtained.

Holding in Temperature Range within ±50° C. of Cooling Stop Temperature for 2 Seconds or More and 25 Seconds or Less A lower bainitic transformation progresses in a temperature range of the cooling stop temperature to a temperature 50° C. lower than the cooling stop temperature. With the progress of the lower bainitic transformation, the amount of the untransformed austenite decreases, and, therefore, the final amount of the as-quenched martensite is reduced, which improves bendability. Producing this effect requires that holding be performed for 2 seconds or more and 25 seconds or less in the range of the point at which the cooling is terminated, which is the cooling stop temperature of 200° C. or higher and 350° C. or lower, to the point of reheating, that is, the temperature range within ±50° C. of the cooling stop temperature. If the time period is less than 2 seconds, the progress of the lower bainitic transformation is insufficient, and, consequently, the desired effect is not produced, and if the time period is more than 25 seconds, the effect no longer increases, and in addition, in the next step, an effect of reheating exhibits variations, which results in significant variations in the material properties, in particular, strength. Preferably, the time period is 3 seconds or more and 20 seconds or less.

Heating Temperature: 300° C. or Higher and 500° C. or Lower

Holding Time in Temperature Range of 300° C. or Higher and 500° C. or Lower: 480 Seconds or More and 1800 Seconds or Less In the holding in the temperature range of 300° C. or higher and 500° C. or lower, purposes are to concentrate C in the retained austenite, thereby ensuring that the retained austenite remains when the cooling to room temperature is carried out and to temper a portion transformed into martensite in heating. If the holding temperature is lower than 300° C., or the holding time is less than 480 seconds, the concentration in the retained austenite is not achieved, and, consequently, austenite, which is thermally unstable, is transformed into martensite when the cooling to room temperature is carried out. As a result, the desired amount of retained austenite cannot be obtained. In addition, the tempering of the as-quenched martensite, which is hard, does not progress sufficiently. On the other hand, if the holding temperature is higher than 500° C., or the holding time is more than 1800 seconds, cementite precipitates and decomposes in the austenite, and as a result, the desired amount of retained austenite cannot be obtained. In addition, if the tempering progresses excessively, the desired strength cannot be achieved. Accordingly, in the reheating after the cooling to a temperature of 200° C. to 350° C. is carried out, holding is to be performed in the range of 300° C. or higher and 500° C. or lower for 480 seconds or more and 1800 seconds or less.

EXAMPLES

Steel sheets to be evaluated were each produced as follows. A steel starting material having the chemical composition shown in Table 1 and a thickness of 250 mm was subjected to hot rolling, pickling, and cold rolling; subsequently, the resulting steel sheet was annealed in a continuous annealing furnace under the conditions shown in Table 2; and subsequently, the resulting steel sheet was subjected to temper rolling, which was performed with an elongation rate of 0.2% to 0.4%. Some of the steel sheets were subjected to a heat treatment step, which was performed in a box annealing furnace before the cold rolling or before the annealing step. The obtained steel sheets were evaluated by using the following procedures.

(i) Examination of Microstructure (Area Fractions of Metallurgical Structure)

A piece was cut from the steel sheet such that a cross section along a sheet thickness and parallel to the rolling direction served as the surface to be examined. A sheet thickness middle portion was revealed by performing etching with 1% nital, and images of a sheet thickness ¼ depth position from a surface of the steel sheet (hereinafter referred to simply as "sheet thickness ¼ t portion") were captured for 10 fields of view by using a scanning electron microscope at a magnification of 2000×. Ferrite is a constituent having no observable corrosion traces or second-phase constituents in the grains. Upper bainite is a constituent having corrosion traces and a second-phase constituent that are recognizable in the grains, and tempered martensite and lower bainite are constituents having a lath structure and a fine second-phase constituent that are observable in the grains. The total amount of upper bainite, lower bainite, and tempered martensite constituents was determined as the sum of the area fractions of all of these.

For the measurement of BCC iron that surrounded retained austenite having an equivalent circular diameter of 1 μm or less, EBSD was performed on the same cross section as that used in the SEM examination. Specifically, regarding a region of $1\times10^3$ $\mu m^2$ or larger in the sheet thickness ¼ t portion were analyzed with a measurement step of 0.1 μm. Regarding the crystal structure disturbances, BCC iron having a KAM value of 1° or less was identified by using a KAM (Kernel average misorientation) method, and retained austenite was identified by using a phase map.

For the measurement of the area fractions, an intercept method was used for both the SEM images and the EBSD images. In the obtained photographs, 20 horizontal lines and 20 vertical lines having an actual length of 30 μm were drawn such that a lattice pattern was formed. The constituent present at each of the intersection points was identified, and the area fraction of each of the constituents was determined as the ratio of the number of the intersection points having the constituent to the number of all the intersection points. In this instance, for each of the measurement points, BCC iron having a KAM value of 1° or less that surrounded the periphery of retained austenite having an equivalent circular diameter of 1 μm or less which does not straddle a high-angle grain boundary with a misorientation of 15° or more and does not straddle BCC iron having a KAM value of more than 1°, and BCC iron having a KAM value of 1° or less that was in contact with 90% or more of an entire peripheral length of a retained austenite having an equivalent circular diameter of 1 μm or less were identified as BCC iron having a KAM value of 1° or less and surrounded retained austenite having an equivalent circular diameter of 1 μm or less. According to this definition, BCC iron that conforms to the following (a) or (b) is outside the range of the definition for the BCC iron that has a misorientation of 1° or less and surrounds retained austenite having an equivalent circular diameter of 1 μm or less, and only BCC iron that conforms to the following (c) is within the range of the definition.

(a) BCC iron in which a retained austenite having an equivalent circular diameter of 1 μm or less straddles a high-angle grain boundary with misorientation of 15° or more and is in contact with two crystal grains of BCC iron, and, in both of the two regions, the boundary between the BCC iron and the retained austenite having an equivalent circular diameter of 1 μm or less has a length more than 10% of the entire length of the periphery of the retained austenite having an equivalent circular diameter of 1 μm or less (b) BCC iron containing crystal grains of BCC iron that has a KAM value of 1° or more and is located adjacent to retained austenite having an equivalent circular diameter of 1 μm or less (c) BCC iron in which, although retained austenite having an equivalent circular diameter of 1 μm or less contacts two crystal grains of BCC iron and straddles a high-angle grain boundary with misorientation of 15° or more, in one of the two regions, the boundary between the BCC iron and the retained austenite having an equivalent circular diameter of 1 μm or less has a length not more than 10% of the entire length of the periphery of the retained austenite having an equivalent circular diameter of 1 μm or less.

FIG. 1 is a schematic diagram illustrating (a) to (c), described above. Note that for the calculation of the area fraction of BCC iron having a misorientation of more than 1°, the calculation may be performed as follows: 100%−(the area fraction of BCC iron having a misorientation of 1° or less and surrounded retained austenite having an equivalent circular diameter of 1 μm or less+the area fraction of BCC iron having a misorientation of 1° or less and surrounded retained austenite having an equivalent circular diameter of more than 1 μm+the area fraction of retained austenite or a volume fraction thereof determined by XRD).

(ii) Measurement of Fraction of Retained Austenite by XRD

The steel sheet was polished so as to reveal a sheet thickness ¼ position and was then chemically polished for another 0.1 mm. The resulting surface was analyzed with an X-ray diffractometer by using Mo-Kα radiation. Integrated intensities of reflection of the (200) plane, (220) plane, and (311) plane of the FCC iron (austenite) and the (200) plane, (211) plane, and (220) plane of the BCC iron (ferrite) were measured. From an intensity ratio, which is the ratio of the integrated intensities of reflection of the planes of the FCC iron (austenite) to the integrated intensities of reflection of the planes of the BCC iron (ferrite), a proportion of the austenite was determined and regarded as the fraction of the retained austenite.

(iii) Tensile Test

A JIS No. 5 tensile test piece was cut from the obtained steel sheet in a direction perpendicular to the rolling direction. A tensile test in accordance with the specifications of JIS Z 2241 (2011) was conducted five times, and an average tensile strength (TS), an average uniform elongation (U-El), and an average total elongation (El) were determined. For the tensile test, a crosshead speed of 10 mm/min. was used. Regarding Table 3, a tensile strength of 980 MPa or higher and a product of TS and U-El of 12000 MPa·% or greater were specified as the mechanical properties of a steel sheet required in the steel according to aspects of the present invention.

Furthermore, good formability can be effectively achieved by, when severe deformation is applied, preventing constriction and inhibiting necking and cracking by dispersing strain. In accordance with aspects of the present invention, as conditions for inhibiting necking and cracking with a material that can withstand severe deformation that involves bending-unbending, which is used, for example, in roll forming or the like, a suitable range of the product of the uniform elongation and the tensile strength was specified to be 12000 MPa·% or greater, and a suitable range of a value was specified to be 1.3 or more, the value being defined as follows. On a true stress (σ)-true strain (ε) curve, $d\sigma/d\varepsilon$ at 80% of ε that satisfied the plastic instability condition ($d\sigma/d\varepsilon=0$) was divided by the tensile strength, and the result was the value.

(iv) Bending Test

To investigate bendability, a strip-shaped sample having a width of 100 mm and a length of 35 mm was cut, and, in accordance with JIS Z 2248, a bending test was conducted by using a V-block method with an apex angle of 90°; a minimum die radius (R) at which cracking did not occur was determined, and the minimum die radius (R) was divided by the sheet thickness (t) to determine a limit bending radius (R/t). A preferable range of the limit bending radius (R/t) was specified to be 1.5 or less.

It is apparent that in all of the Invention Examples, the tensile strength TS was 980 MPa or higher, and good formability was achieved. Furthermore, in Invention Examples, in which the area fraction of the BCC iron that surrounded fine retained austenite was 4% or more, a good uniform elongation (U-El), total elongation (El), amount of work hardening, and bendability were exhibited while a tensile strength TS of 980 MPa or higher was achieved. On the other hand, in Comparative Examples, which fell outside the range according to aspects of the present invention, the tensile strength was less than 980 MPa, and/or, the amount of work hardening and/or bendability sought in accordance with aspects of the present invention were not achieved.

TABLE 1

| Steel | Chemical composition (mass %) | | | | | | | | |
|---|---|---|---|---|---|---|---|---|---|
| No. | C | Si | Mn | P | S | Al | N | Others | Notes |
| A | 0.11 | 1.55 | 2.83 | 0.009 | 0.0008 | 0.06 | 0.0042 | — | Invention example |
| B | 0.19 | 1.45 | 2.18 | 0.013 | 0.0012 | 0.03 | 0.0040 | Mo: 0.04 | Invention example |
| C | 0.19 | 1.36 | 2.29 | 0.013 | 0.0014 | 0.06 | 0.0035 | Ti: 0.02<br>B: 0.002 | Invention example |
| D | 0.21 | 1.61 | 2.80 | 0.005 | 0.0012 | 0.02 | 0.0029 | — | Invention example |
| E | 0.19 | 1.48 | 2.60 | 0.008 | 0.0014 | 0.04 | 0.0045 | Ti: 0.02<br>Nb: 0.02<br>B: 0.002 | Invention example |
| F | 0.18 | 1.43 | 2.67 | 0.008 | 0.0005 | 0.05 | 0.0025 | Cu: 0.08<br>Ni: 0.03<br>Cr: 0.04<br>Sb: 0.002<br>REM: 0.001 | Invention example |
| G | 0.19 | 1.50 | 2.78 | 0.014 | 0.0005 | 0.05 | 0.0040 | V: 0.08<br>Mg: 0.008<br>Ca: 0.001 | Invention example |
| H | 0.09 | 1.55 | 2.75 | 0.009 | 0.0007 | 0.05 | 0.0041 | — | Comparative example |
| I | 0.20 | 0.59 | 2.67 | 0.014 | 0.0013 | 0.02 | 0.0027 | — | Comparative example |
| J | 0.19 | 1.36 | 1.48 | 0.006 | 0.0007 | 0.02 | 0.0028 | — | Comparative example |

The underline indicates that the value is outside the range according to aspects of the present invention.

TABLE 2

| | | | Heat treatment step | | Annealing step | | | | |
|---|---|---|---|---|---|---|---|---|---|
| Steel No. | Steel sheet No. | Cold rolling reduction ratio (%) | Heating temperature (° C.) | Heating time (h) | Heating temperature (° C.) | Heating time*1 (s) | Average cooling rate*2 (° C./s) | Cooling stop temperature*3 (° C.) | Holding time*4 (s) |
| 1 | A | 59 | — | — | 840 | 155 | 12 | 478 | 48 |
| 2 | B | 50 | — | — | 845 | 147 | 16 | 495 | 40 |
| 3 | | 67 | 520 | 4 | 840 | 175 | 14 | 473 | 22 |
| 4 | C | 59 | — | — | 855 | 181 | 13 | 475 | 51 |
| 5 | | 71 | 550 | 3 | 843 | 149 | 19 | 486 | 32 |
| 6 | D | 50 | — | — | 850 | 171 | 12 | 504 | 23 |
| 7 | | 50 | 560 | 5 | 847 | 159 | 18 | 450 | 39 |
| 8 | | 42 | — | — | 850 | 169 | 19 | 490 | 24 |
| 9 | | 54 | — | — | 806 | 152 | 11 | 450 | 16 |
| 10 | | 53 | — | — | 854 | 32 | 18 | 509 | 28 |
| 11 | | 64 | — | — | 847 | 180 | 2 | 488 | 49 |
| 12 | | 65 | — | — | 852 | 159 | 19 | 580 | 55 |
| 13 | | 67 | — | — | 843 | 169 | 9 | 401 | 44 |
| 14 | | 67 | — | — | 854 | 186 | 16 | 455 | 9 |
| 15 | | 62 | — | — | 842 | 189 | 9 | 488 | 49 |
| 16 | | 53 | — | — | 852 | 152 | 19 | 453 | 51 |
| 17 | E | 53 | — | — | 841 | 153 | 17 | 473 | 30 |
| 18 | | 67 | 550 | 3 | 846 | 175 | 10 | 497 | 42 |
| 19 | | 44 | — | — | 845 | 170 | 12 | 488 | 39 |
| 20 | F | 54 | — | — | 844 | 171 | 14 | 480 | 55 |
| 21 | | 71 | 540 | 4 | 843 | 163 | 14 | 492 | 43 |
| 22 | G | 53 | — | — | 846 | 160 | 17 | 480 | 31 |
| 23 | H | 50 | — | — | 846 | 176 | 17 | 501 | 31 |
| 24 | I | 55 | — | — | 844 | 151 | 15 | 470 | 51 |
| 25 | J | 50 | — | — | 847 | 185 | 16 | 509 | 33 |
| 26 | E | 50 | 520 | 5 | 830 | 155 | 17 | 479 | 29 |

| | Annealing step | | | | | |
|---|---|---|---|---|---|---|
| Steel No. | Average cooling rate *5 (° C./s) | Cooling stop temperature*6 (° C.) | Holding time*7 (s) | Reheating temperature (° C.) | After-reheating holding time (s) | Notes |
| 1 | 12 | 235 | 11 | 402 | 801 | Invention example |
| 2 | 14 | 223 | 13 | 384 | 841 | Invention example |
| 3 | 17 | 242 | 18 | 422 | 752 | Invention example |
| 4 | 11 | 238 | 21 | 386 | 583 | Invention example |
| 5 | 16 | 249 | 17 | 416 | 680 | Invention example |
| 6 | 15 | 310 | 20 | 376 | 865 | Invention example |
| 7 | 16 | 269 | 13 | 422 | 865 | Invention example |
| 8 | 10 | 255 | 17 | 401 | 614 | Comparative example |
| 9 | 15 | 278 | 18 | 423 | 637 | Comparative example |

TABLE 2-continued

| | | | | | | |
|---|---|---|---|---|---|---|
| 10 | 17 | 217 | 10 | 418 | 808 | Comparative example |
| 11 | 15 | 277 | 18 | 401 | 772 | Comparative example |
| 12 | 11 | 297 | 17 | 407 | 729 | Comparative example |
| 13 | 18 | 280 | 12 | 415 | 580 | Comparative example |
| 14 | 17 | 252 | 10 | 428 | 634 | Comparative example |
| 15 | 3 | 210 | 18 | 429 | 899 | Comparative example |
| 16 | 11 | 183 | 22 | 414 | 791 | Comparative example |
| 17 | 11 | 219 | 20 | 391 | 542 | Invention example |
| 18 | 18 | 235 | 12 | 380 | 576 | Invention example |
| 19 | 14 | 224 | 18 | 391 | 622 | Comparative example |
| 20 | 15 | 287 | 21 | 384 | 705 | Invention example |
| 21 | 9 | 216 | 14 | 410 | 885 | Invention example |
| 22 | 10 | 286 | 17 | 393 | 662 | Invention example |
| 23 | 14 | 272 | 20 | 386 | 884 | Comparative example |
| 24 | 18 | 222 | 12 | 393 | 804 | Comparative example |
| 25 | 11 | 258 | 15 | 415 | 623 | Comparative example |
| 26 | 10 | 272 | 20 | 409 | 651 | Invention example |

*1: Holding time in a temperature of 815° C. or higher
*2: Average cooling rate over from 800° C. to 520° C.
*3: Temperature when cooling from 800° C. was forcibly stopped
*4: Holding time in a range of 420° C. to 520° C.
*5: Average cooling rate from 420° C. to 300° C.
*6: Temperature when cooling from 420° C. was forcibly stopped
*7: Holding time at a temperature within ±50° C. of the temperature of *6
The underline indicates that the value is outside the range according to aspects of the present invention.

TABLE 3

| | Metallurgical structure | | | | | | |
|---|---|---|---|---|---|---|---|
| Steel sheet No. | Area fraction of ferrite (%) | Area fraction of as-quenched martensite (%) | Area fraction of BCC iron with 1° or less*1 (%) | Area fraction of BCC iron with more than 1° (%) | Retained austenite (%) | Total amount of upper bainite, lower bainite, and tempered martensite (%) | Tensile strength (MPa) |
| 1 | 2 | 4 | 42 | 48 | 10 | 82 | 1001 |
| 2 | 0 | 3 | 34 | 50 | 11 | 86 | 1036 |
| 3 | 1 | 4 | 35 | 51 | 12 | 83 | 1031 |
| 4 | 2 | 4 | 45 | 38 | 10 | 84 | 1012 |
| 5 | 0 | 8 | 45 | 39 | 15 | 75 | 1022 |
| 6 | 2 | 8 | 26 | 54 | 13 | 75 | 1237 |
| 7 | 1 | 8 | 16 | 67 | 11 | 78 | 1239 |
| 8 | 1 | 4 | 3 | 77 | 15 | 80 | 1280 |
| 9 | 21 | 5 | 3 | 61 | 9 | 64 | 1186 |
| 10 | 2 | 4 | 2 | 80 | 12 | 80 | 1305 |
| 11 | 34 | 3 | 2 | 45 | 15 | 48 | 1045 |
| 12 | 7 | 3 | 3 | 83 | 6 | 84 | 1309 |
| 13 | 2 | 3 | 3 | 78 | 13 | 81 | 1318 |
| 14 | 0 | 3 | 3 | 86 | 9 | 88 | 1313 |
| 15 | 2 | 7 | 62 | 19 | 16 | 75 | 965 |
| 16 | 0 | 8 | 20 | 74 | 5 | 85 | 1235 |
| 17 | 0 | 3 | 15 | 76 | 9 | 87 | 1205 |
| 18 | 2 | 5 | 16 | 61 | 13 | 79 | 1200 |
| 19 | 2 | 11 | 14 | 62 | 10 | 77 | 1249 |
| 20 | 2 | 5 | 20 | 63 | 13 | 79 | 1232 |
| 21 | 2 | 7 | 15 | 70 | 13 | 78 | 1220 |
| 22 | 2 | 3 | 21 | 61 | 14 | 79 | 1207 |
| 23 | 0 | 7 | 18 | 67 | 11 | 81 | 948 |
| 24 | 2 | 3 | 17 | 76 | 3 | 90 | 1095 |
| 25 | 12 | 5 | 4 | 74 | 6 | 77 | 1100 |
| 26 | 1 | 3 | 4.8 | 84 | 12 | 84 | 1102 |

| Steel sheet No. | Uniform elongation (%) | Total elongation (%) | TS × U-EI (MPa · %) | (dσ/dε)/TS | Bendability | Notes |
|---|---|---|---|---|---|---|
| 1 | 12.3 | 20 | 12312 | 1.3 | 1.3 | Invention example |
| 2 | 12.1 | 21 | 12569 | 1.3 | 1.5 | Invention example |
| 3 | 11.8 | 21 | 12189 | 1.5 | 1.5 | Invention example |
| 4 | 12.0 | 21 | 12150 | 1.5 | 1.3 | Invention example |
| 5 | 12.3 | 21 | 12526 | 1.4 | 1.5 | Invention example |
| 6 | 9.8 | 17 | 12076 | 1.4 | 1.3 | Invention example |
| 7 | 9.9 | 17 | 12266 | 1.4 | 1.3 | Invention example |
| 8 | 8.9 | 14 | 11392 | 1.2 | 2.6 | Comparative example |
| 9 | 9.2 | 15 | 10911 | 1.2 | 2.7 | Comparative example |
| 10 | 8.6 | 13 | 11223 | 1.5 | 2.8 | Comparative example |

TABLE 3-continued

| | | | | | | |
|---|---|---|---|---|---|---|
| 11 | 10.9 | 18 | 11391 | 1.2 | 2.0 | Comparative example |
| 12 | 9.1 | 14 | 11912 | 1.1 | 3.0 | Comparative example |
| 13 | 9.5 | 14 | 12581 | 1.2 | 2.6 | Comparative example |
| 14 | 9.0 | 14 | 11817 | 1.2 | 2.7 | Comparative example |
| 15 | 12.8 | 22 | 12395 | 1.5 | 1.5 | Comparative example |
| 16 | 9.6 | 16 | 11856 | 1.2 | 1.8 | Comparative example |
| 17 | 10.0 | 18 | 12102 | 1.3 | 1.5 | Invention example |
| 18 | 10.4 | 18 | 12449 | 1.4 | 1.5 | Invention example |
| 19 | 8.9 | 15 | 11116 | 1.3 | 2.5 | Comparative example |
| 20 | 9.8 | 18 | 12040 | 1.4 | 1.5 | Invention example |
| 21 | 9.9 | 18 | 12089 | 1.5 | 1.5 | Invention example |
| 22 | 10.0 | 18 | 12043 | 1.6 | 1.3 | Invention example |
| 23 | 13.0 | 23 | 12358 | 1.3 | 2.0 | Comparative example |
| 24 | 10.5 | 17 | 11498 | 1.1 | 2.0 | Comparative example |
| 25 | 10.2 | 18 | 11220 | 1.2 | 1.9 | Comparative example |
| 26 | 10.9 | 17 | 12012 | 1.3 | 1.5 | Invention example |

*1: Area fraction of BCC iron having a KAM value of 1° or less and surrounded retained austenite having an equivalent circular diameter of 1 μm or less
The underline indicates that the value is outside the range according to aspects of the present invention.

The invention claimed is:

1. A steel sheet comprising:

a chemical composition containing, in mass %,

C: 0.10% or more and 0.23% or less;

Si: 1.30% or more and 2.20% or less;

Mn: 2.0% or more and 3.2% or less;

P: 0.05% or less;

S: 0.005% or less;

Al: 0.005% or more and 0.100% or less; and

N: 0.0060% or less, the balance being Fe and incidental impurities; and a microstructure including ferrite with an area fraction of 4% or less (including 0%), as-quenched martensite with an area fraction of 10% or less (including 0%), retained austenite with an amount of 7% or more and 20% or less, and upper bainite, lower bainite, and tempered martensite with a total area fraction of more than 71% and less than 93%, wherein:

BCC iron having a misorientation of 1° or less and surrounds retained austenite having an equivalent circular diameter of 1 μm or less is present with an area fraction of 5% or more and 50% or less; and BCC iron having a misorientation of more than 1° is present with an area fraction of 25% or more and 85% or less.

2. The steel sheet according to claim 1, wherein the chemical composition further contains at least one selected from the following groups A to C consisting of:

Group A: in mass %,

Sb: 0.001% or more and 0.050% or less;

Group B: in mass %, one or more of:

Ti: 0.001% or more and 0.1% or less;

Nb: 0.001% or more and 0.1% or less;

V: 0.001% or more and 0.3% or less;

Ni: 0.01% or more and 0.1% or less;

Cr: 0.01% or more and 1.0% or less; and

B: 0.0002% or more and 0.0050% or less;

Group C: in mass %, one or more of:

Cu: 0.01% or more and 0.2% or less;

Mo: 0.01% or more and 1.0% or less;

a REM: 0.0002% or more and 0.050% or less;

Mg: 0.0002% or more and 0.050% or less; and

Ca: 0.0002% or more and 0.050% or less.

3. A method for manufacturing a steel sheet according to claim 1, the method comprising:

cold rolling a hot-rolled steel sheet having the chemical composition according claim 2 at a cold rolling reduction ratio of 46% or higher; and annealing the cold-rolled steel sheet including, after the cold rolling:

heating and holding the cold-rolled steel sheet at 815° C. or higher for 130 seconds or more;

subsequently, cooling the cold-rolled steel sheet with an average cooling rate from 800° C. to 520° C. of 8° C./s or higher to a temperature range of 420° C. or higher and 520° C. or lower;

holding the cold-rolled steel sheet in the temperature range for 12 seconds or more and 60 seconds or less;

cooling the cold-rolled steel sheet with an average cooling rate in a temperature range from 420° C. to 300° C. of 8° C./s or higher to a cooling stop temperature of 200° C. or higher and 350° C. or lower;

holding the cold-rolled steel sheet in a temperature range within ±50° C. of the cooling stop temperature for 2 seconds or more and 25 seconds or less; and thereafter, heating the cold-rolled steel sheet to a temperature of 300° C. or higher and 500° C. or lower and, subsequently, holding the cold-rolled steel sheet in the temperature range for 480 seconds or more and 1800 seconds or less.

4. A method for manufacturing a steel sheet according to claim 2, the method comprising:

cold rolling a hot-rolled steel sheet having the chemical composition according claim 2 at a cold rolling reduction ratio of 46% or higher; and annealing the cold-rolled steel sheet including, after the cold rolling:

heating and holding the cold-rolled steel sheet at 815° C. or higher for 130 seconds or more;

subsequently, cooling the cold-rolled steel sheet with an average cooling rate from 800° C. to 520° C. of 8° C./s or higher to a temperature range of 420° C. or higher and 520° C. or lower;

holding the cold-rolled steel sheet in the temperature range for 12 seconds or more and 60 seconds or less;

cooling the cold-rolled steel sheet with an average cooling rate in a temperature range from 420° C. to 300° C. of 8° C./s or higher to a cooling stop temperature of 200° C. or higher and 350° C. or lower;

holding the cold-rolled steel sheet in a temperature range within ±50° C. of the cooling stop temperature for 2 seconds or more and 25 seconds or less; and thereafter, heating the cold-rolled steel sheet to a temperature of 300° C. or higher and 500° C. or lower and, subsequently, holding the cold-rolled steel sheet in the temperature range for 480 seconds or more and 1800 seconds or less.

* * * * *